US011771230B2

(12) United States Patent
Navarro

(10) Patent No.: US 11,771,230 B2
(45) Date of Patent: Oct. 3, 2023

(54) ERGONOMIC MASSAGE CHAIR

(71) Applicant: David Navarro, Las Vegas, NV (US)

(72) Inventor: David Navarro, Las Vegas, NV (US)

( * ) Notice: Subject to any disclaimer, the term of this patent is extended or adjusted under 35 U.S.C. 154(b) by 108 days.

(21) Appl. No.: 17/447,718

(22) Filed: Sep. 15, 2021

(65) Prior Publication Data

US 2021/0401179 A1 Dec. 30, 2021

Related U.S. Application Data

(63) Continuation-in-part of application No. 16/724,900, filed on Feb. 4, 2020, now abandoned.

(51) Int. Cl.

| | |
|---|---|
| ***A47C 9/00*** | (2006.01) |
| ***A47C 7/02*** | (2006.01) |
| ***A61H 15/00*** | (2006.01) |
| ***A61H 39/04*** | (2006.01) |
| ***A47C 7/18*** | (2006.01) |
| ***A47C 7/40*** | (2006.01) |

(52) U.S. Cl.

CPC ..... *A47C 9/002* (2013.01); *A47C 7/029* (2018.08); *A47C 7/18* (2013.01); *A47C 7/40* (2013.01); *A61H 39/04* (2013.01); *A61H 2015/005* (2013.01); *A61H 2015/0042* (2013.01); *A61H 2201/0138* (2013.01); *A61H 2201/0149* (2013.01); *A61H 2201/168* (2013.01); *A61H 2201/1654* (2013.01)

(58) Field of Classification Search

CPC ..... A47C 9/002; A61H 2201/0149

See application file for complete search history.

(56) References Cited

U.S. PATENT DOCUMENTS 2,742,957 A * 4/1956 Young ..... B60N 2/7064 5/256
3,358,679 A * 12/1967 Borrelli ..... A61H 1/0218 601/61
5,056,506 A * 10/1991 Verduci ..... A47C 15/008 601/24

(Continued)

FOREIGN PATENT DOCUMENTS

GB 2143436 A * 2/1985 ..... A61H 1/00
JP 2003299711 A * 10/2003

(Continued)

*Primary Examiner* — Robert Canfield
(74) *Attorney, Agent, or Firm* — Tatonetti IP

(57) ABSTRACT

An ergonomic massage chair is configured with back and bottom structures held up by a pair of legs. The various support bars and structure of the ergonomic massage chair may be comprised of, in typical implementations, metal, but plastic and other suitable structures are also possible. The back structure has perimeter support bars that form the base of the back support, and horizontal support bars extend from a left perimeter support bar to a right perimeter support bar. The bottom structure likewise has a perimeter support bar that forms the structure of the bottom. A horizontal support bar extends from a left perimeter support bar to a right perimeter support bar. Nodes are attached to the ergonomic chair, and stability balls fit inside openings created by the support bars and nodes. A cover having memory foam pillows therein encapsulates the chair to provide users with customized setups that suit them.

20 Claims, 7 Drawing Sheets

(56) References Cited

U.S. PATENT DOCUMENTS 6,217,121 B1 * 4/2001 Mollet ..... A47C 7/144
297/452.21
6,334,650 B1 * 1/2002 Chien-Chuan ..... A47C 7/46
297/230.11
6,511,446 B1 * 1/2003 Wu ..... A61F 7/02
601/56
6,616,240 B1 * 9/2003 Theosabrata ..... A47C 7/02
297/452.64
6,669,291 B1 * 12/2003 Hsiao ..... A47C 7/40
297/284.3
7,320,668 B1 * 1/2008 Warder ..... A61H 7/001
601/136
9,144,317 B2 * 9/2015 Yang ..... A47C 9/002
9,980,875 B2 * 5/2018 Yang ..... A47C 9/002
2004/0226102 A1 * 11/2004 Hampton ..... A61G 5/1043
5/713
2005/0015031 A1 * 1/2005 Lin ..... A61H 15/00
601/115
2006/0238006 A1 * 10/2006 Baranov ..... A47C 1/0303
297/284.3
2007/0027412 A1 * 2/2007 Li ..... A61H 15/0078
601/90
2011/0034839 A1 * 2/2011 Yang ..... A61H 15/0078
601/128
2014/0049091 A1 * 2/2014 Gross ..... A47C 31/11
297/452.63
2014/0167464 A1 * 6/2014 Kordyl ..... A47C 31/126
297/284.3
2015/0173515 A1 * 6/2015 Freedman ..... A47C 7/443
297/313
2016/0106620 A1 * 4/2016 Uno ..... A61H 9/0078
601/149
2020/0121547 A1 * 4/2020 Yang ..... A47C 9/002
2022/0211179 A1 * 7/2022 Vasanth ..... A61B 5/1116

FOREIGN PATENT DOCUMENTS

JP 2004057757 A * 2/2004
JP 3141092 U * 4/2008

* cited by examiner

ERGONOMIC MASSAGE CHAIR

CROSS-REFERENCES TO RELATED APPLICATIONS

This Non-Provisional Patent Application is a Continuation-In-Part Application of U.S. patent application Ser. No. 16/724,900, filed Feb. 4, 2020, entitled "Swedish for Throne Ergonomic System," the entire contents of which are hereby incorporated herein by reference.

BACKGROUND

Many ergonomic support chairs are designed for stability instead of flexibility and fluidity. The body is a constant fluctuation of skeletal and muscular flow and movement. Chairs typically provide an arrangement where a soft cushion that supports the average person's weight makes for a seated position that cannot achieve dynamic, ergonomic accountability. Instead, modern office chairs and the like create a sedimentary seated work environment that causes the body to slowly become accustomed to static life. As a result, joints begin to ache, and the muscles become fatigued, and people become dependent on caffeine to stay energized due to the lack of blood circulation. These modern chairs are also responsible in part for the early onset of erectile dysfunction in men and the early onset of incontinence in women. Many skeletal issues are also derived from the design of many ergonomic chairs in today's market.

SUMMARY

An ergonomic massage chair is configured with a back perimeter structure, and a bottom structure held up by a pair of legs. The various support bars and structure of the ergonomic massage chair may be comprised of, in typical implementations, metal, but plastic and other suitable materials are also possible. The back perimeter structure has horizontal support bars that form the back support base. Horizontal support bars extend from a left perimeter support bar to a right perimeter support bar. The bottom perimeter structure likewise has a horizontal support bar that forms the structure of the bottom. In addition, a horizontal support bar extends from a left perimeter support bar to a right perimeter support bar.

The various support bars that make up a cage-like structure are adapted with attachable nodes to which stability balls are connected. The nodes include a hole at their top that enables a screw and washer to fasten the node to a corresponding threaded hole in the support bars and chair's structure. As the nodes are comprised of a rubber material, the stability balls can be pressured in openings surrounding the nodes and support bars so that a press-fit engagement is established and the stability balls stay in place. The stability balls may be comprised of, for example, polyvinyl chloride, also referred to as soft plastic vinyl, to provide conformable properties.

When the stability balls are secured to openings inside the cage-like chair, a form-fitting cover may be placed over the entire or part of the chair and reach to or adjacent to the floor. The cover may have at least two layers so that various memory foam pillows are secured therebetween. The pillows may be stitched inside the cover so as not to move or could be secured in place via hook-and-loop fasteners or other fasteners.

A user can adapt the chair to suit their sitting style using the placeable inserts lining the sleeve for the unit. The sleeve can accommodate the curvatures of the spine and can also be customized based on the user's specific needs, such as users with scoliosis or sciatica and preventative measures such as degenerative disc disease. Furthermore, various stability balls and inflatable pillows create a seating situation that provides awareness of a user's lack of healthy posture. This awareness allows the user to correct mistakes as they occur instead of sitting comfortably in an incorrect posture. The ergonomic chair may be utilized by those who work eight to 10 hours a day in a seated position, and the sleeve adaptable to many other chairs may be taken and interchanged for those who, for example, may be sitting in a car all day or on a plane.

This Summary is provided to introduce a selection of concepts in a simplified form that is further described below in the Detailed Description. This Summary is not intended to identify key features or essential features of the claimed subject matter, nor is it intended to be used as an aid in determining the scope of the claimed subject matter. Furthermore, the claimed subject matter is not limited to implementations that solve any or all disadvantages noted in any part of this disclosure. These and various other features will be apparent from a reading of the following Detailed Description and a review of the associated drawings.

BRIEF DESCRIPTION OF THE DRAWINGS

Like reference numerals indicate like elements in the drawings. Elements are not drawn to scale unless otherwise indicated.

DETAILED DESCRIPTION

Figure 1:
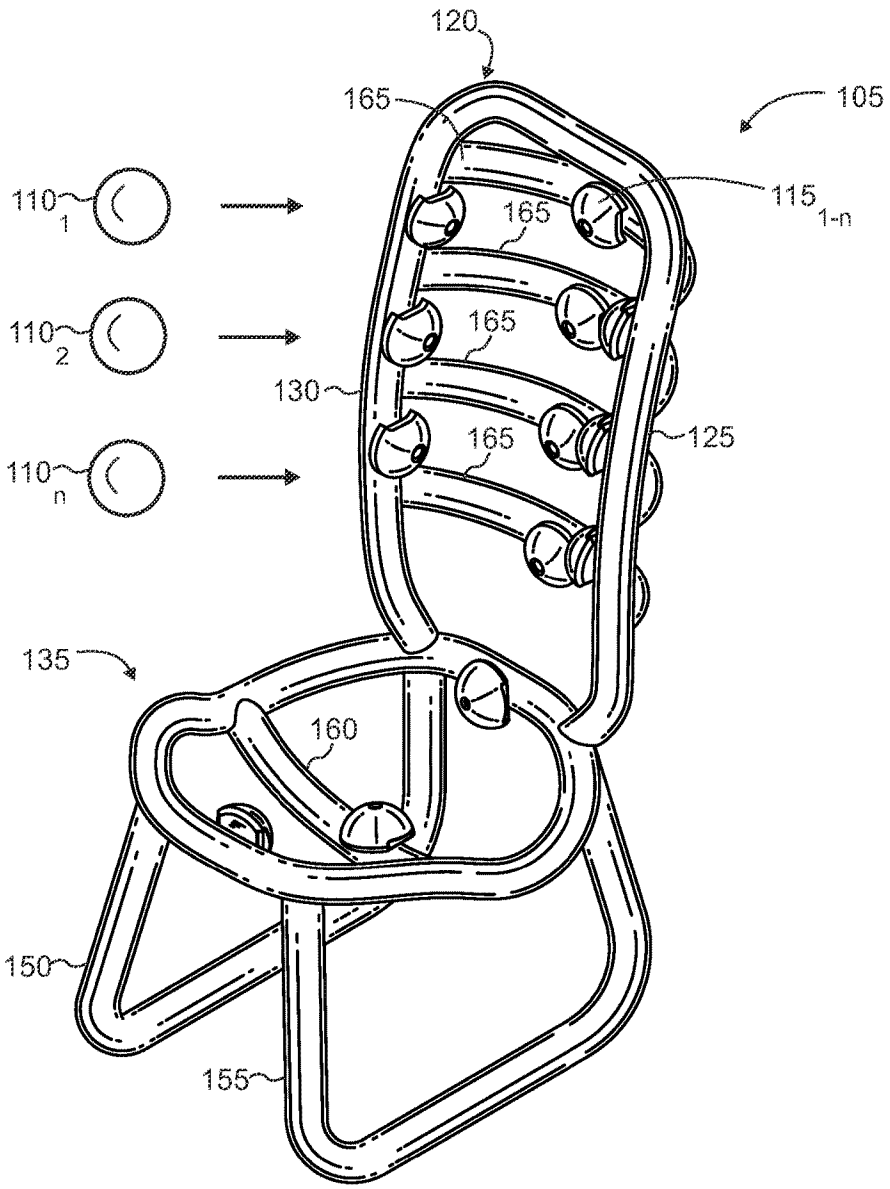
FIGS. 1-4 show illustrative representations of an ergonomic massage chair having recessed support bars and nodes attached to the various support bars.
Figure 2:
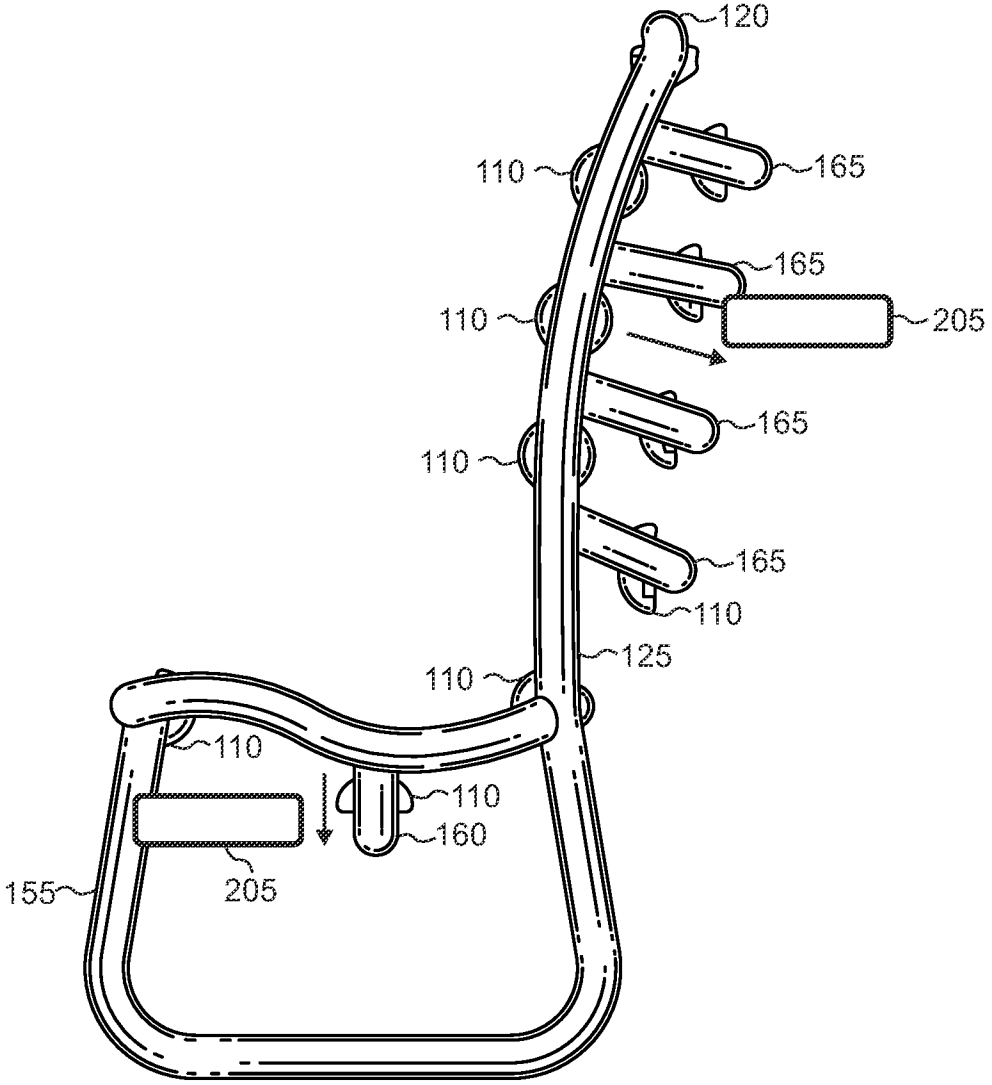
Figure 4:
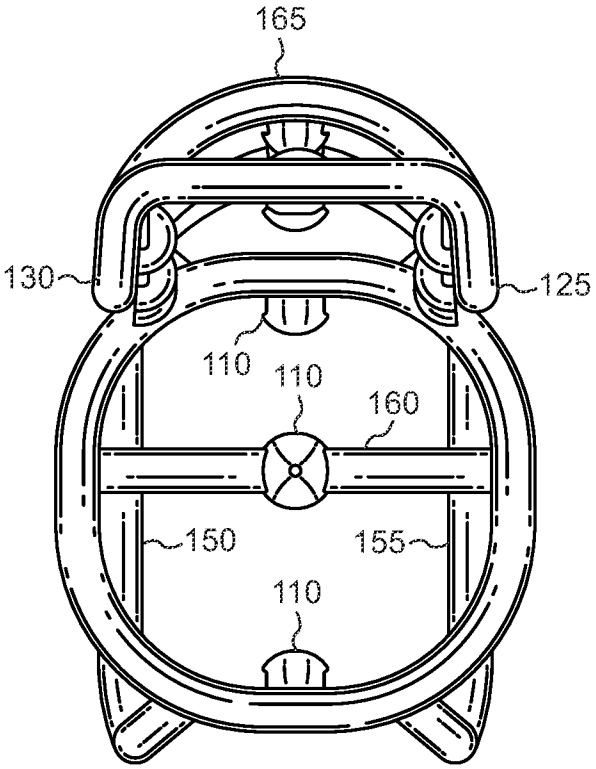
Figure 3:
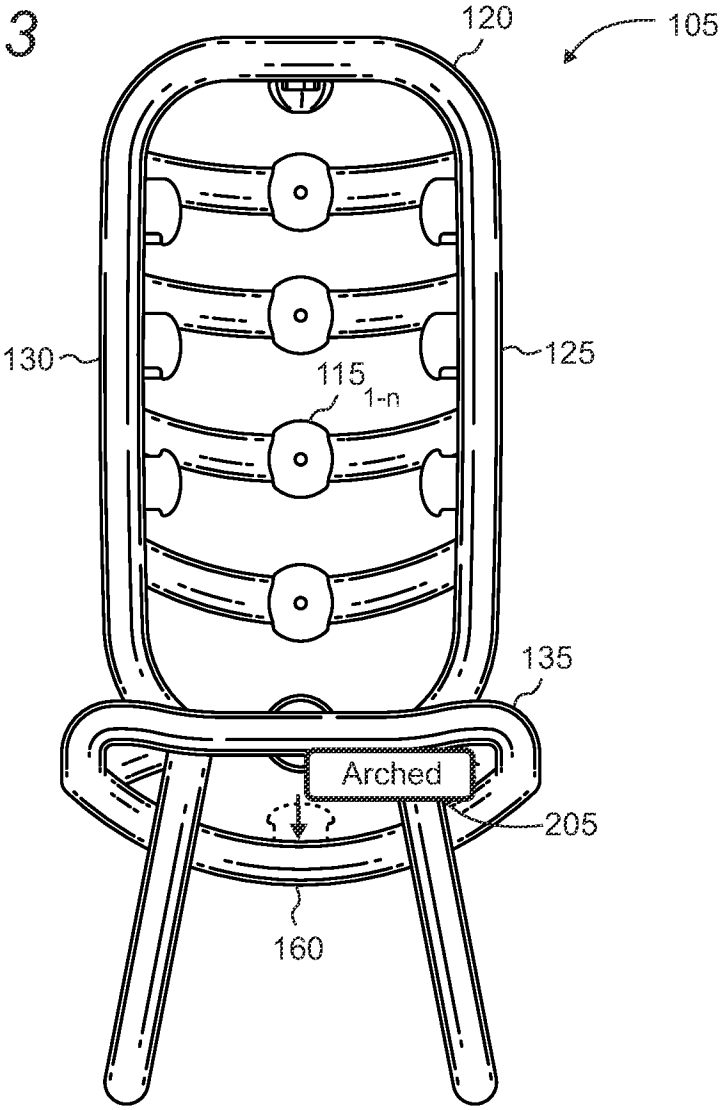

FIGS. 1-4 show illustrative representations in which an ergonomic massage chair 105 is configured with a cage-like structure that utilizes nodes 115 and stability balls 110 to provide a customizable ergonomic setup for an array of users. The chair is configured of bars that may be comprised of a metal, such as steel, titanium, etc., or other suitable material that can withstand a user's weight, such as plastic. The chair includes a back perimeter structure 120 and a bottom perimeter structure 135 that provide the chair's framework. Support bars 160, 165 extend horizontally for the back support structure and the bottom support structure to provide support to a user. The chair includes legs 150, 155 that support the chair.

While two legs 150, 155 are shown in the drawings, other arrangements can also be possible, such as three legs, four legs, etc. Furthermore, while the back perimeter structure 120 shows four horizontal support bars 165 and the bottom perimeter structure 135 shows one horizontal support bar 160, additional or fewer support bars may be implemented. For example, the back support structure may utilize two, three, five, or more support bars, and the bottom support structure may utilize two or more support bars. The support bars may be narrower to accommodate additional support bars or wider to support less.

The ergonomic massage chair's structure includes a series of nodes 115 strategically positioned throughout the chair. The nodes are adapted to receive stability (or yoga) balls 110. The nodes include holes on their top surfaces that extend to their bottom surfaces so a screw and washer can secure to a threaded hole on the support bars and the chair's structure.

The support bars 160 and 165 are arched to partially conform to a user's back and accommodate the additional space occupied by nodes 115 and stability balls 110. Thus, as representatively shown by numeral 205, the arches may be sized proportionately to accommodate the size of a node and the stability ball. Even further and as discussed in further detail below, memory foam pillows attached to a cover that at least partially encapsulates the chair can be used with the ergonomic massage chair 105, in which case the arches even further accommodate those pillows and provides appropriate comfort points to a user.

Figure 6:
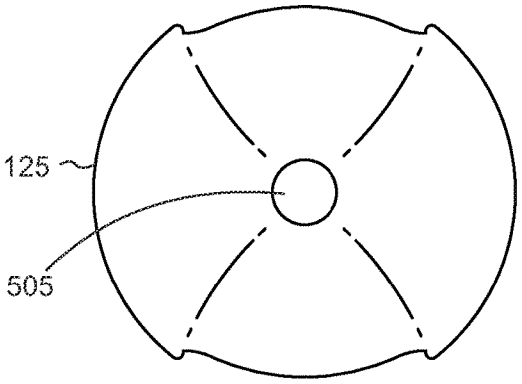
FIG. 6 shows an illustrative top view of the node.
Figure 7:
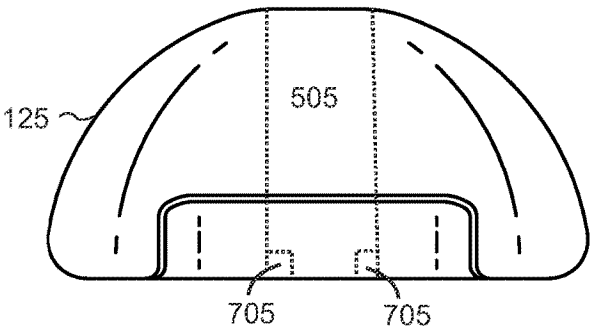
FIG. 7 shows an illustrative representation of the node's hole and stopper on which the screw rests.
Figure 5:
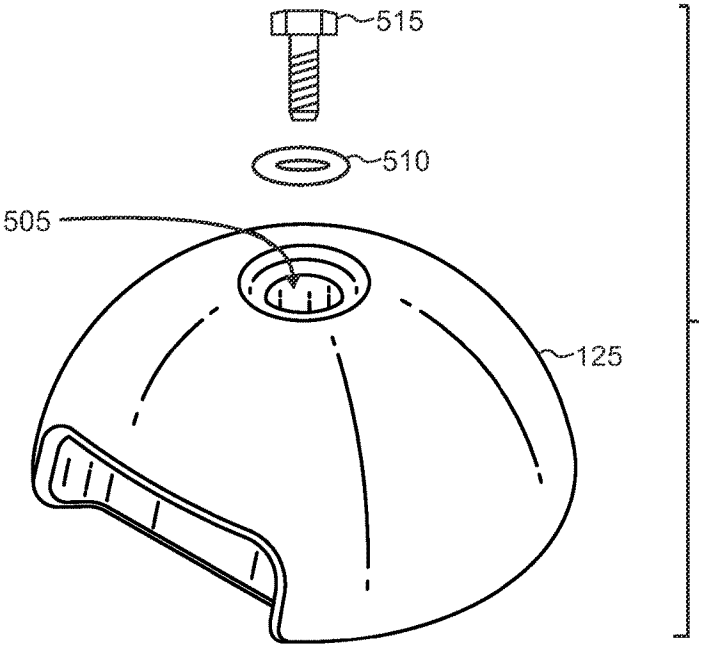
FIG. 5 shows an illustrative representation of a node that uses a screw and washer to secure the node to the chair.

FIGS. 5-7 show illustrative representations in which a screw 515 and washer 510 are aligned with a hole 505 on node 125. The hole includes stoppers that prevent the screw head from going through the bottom. As shown from FIG. 7, the hole extends fully through from the top to the bottom of the node. The screw extends from the bottom surface of the node and engages with a threaded hole on the various support bars or structures of the ergonomic massage chair 105, such that the nodes are permanently affixed to the chair. The screws, however, can be removed to, for example, replace a damaged or worn node. The threaded holes may be placed, for example, in the locations of the nodes shown in FIGS. 1-4.

Figure 8:
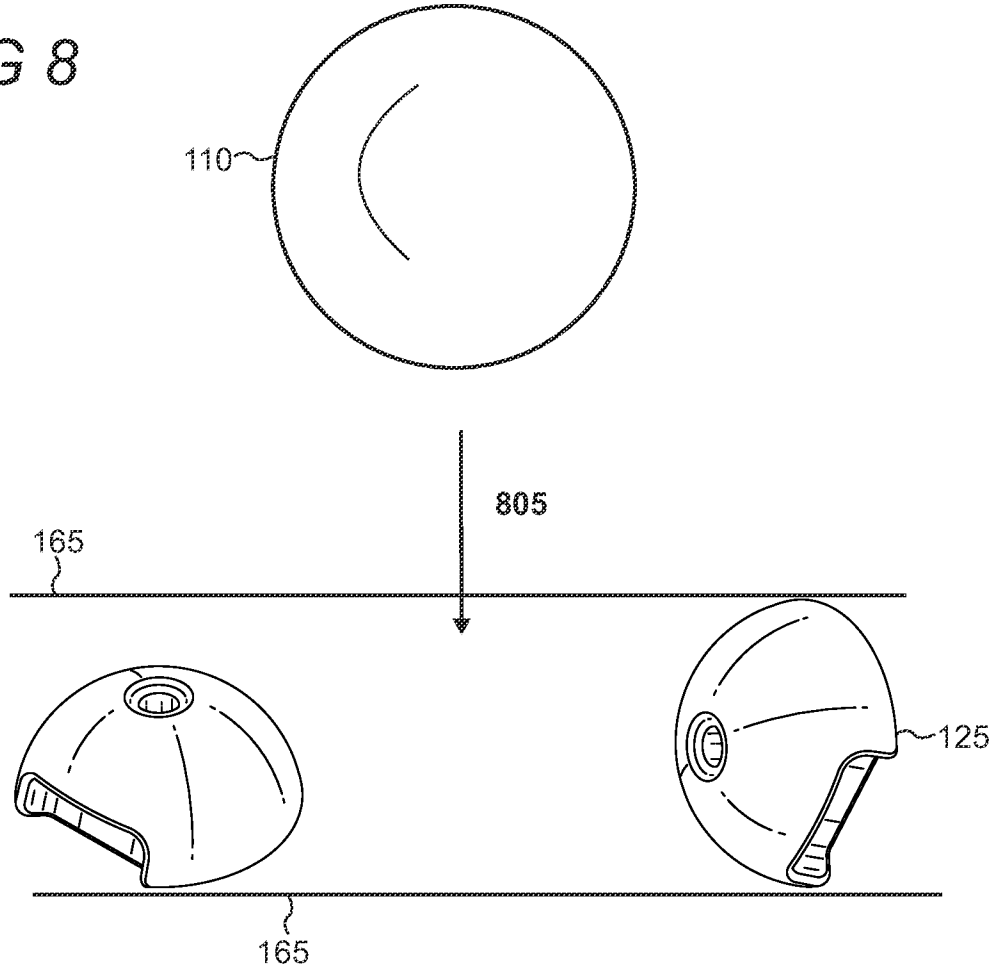
FIG. 8 shows an illustrative representation of a stability ball aligned an opening between support bars and nodes.

FIG. 8 shows an illustrative representation in which the stability ball 110 is aligned with one of the openings inside the cage-like, namely between nodes 125 and support bars 165. The user can press the conformable stability ball at least partially in the opening between the support bars and nodes to secure it in place, as representatively shown by numeral 805. Since the stability ball is made of a conformable material, such as polyvinyl chloride, also called soft plastic vinyl, the ball can be malleable enough to secure in the opening. Furthermore, the rubber composition of the node can help capture the ball in place to create a press-fit scenario. The stability balls are big enough to fit comfortably in the openings, not simply to extend through the support bars.

Figure 9:
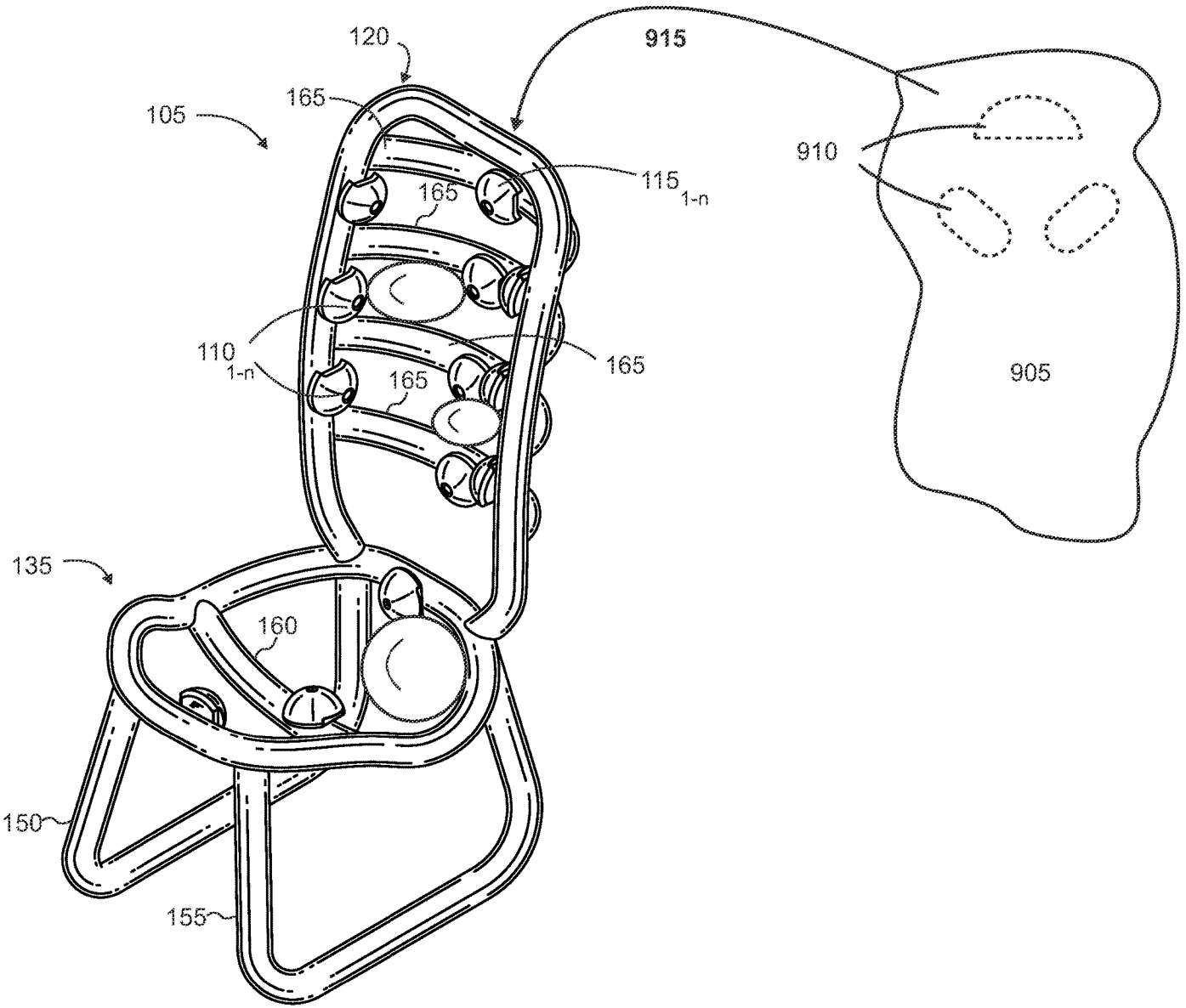
FIG. 9 shows an illustrative representation of the stability balls secured throughout the ergonomic chair's openings and a form-fitting cover to be fitted over the chair's structure.

FIG. 9 shows an illustrative representation in which the stability balls are fitted among the chair's structure. The stability balls may be secured in place as discussed with respect to FIG. 8. Any number of stability balls can be used based on the specific use scenario and user's treatment. While only three balls are shown in various places in FIG. 9, additional or fewer balls may also be used.

Once in place, a form-fitting cover 905 may be placed over the ergonomic massage chair 105 such that at least the back support structure 120 and bottom support structure 135 are covered. The cover may extend to the floor underneath the legs 150, 155, or may end adjacent to the floor. The cover substantially encapsulating the chair may include the cover reaching or being adjacent to the legs 150, 155. The cover is form-fitting so that there is an overall snug arrangement against the chair's structure. However, in some implementations, the cover may only cover the back support structure and fall short of the bottom support structure.

Although not shown, the chair 105 may include various hook-and-loop fasteners on the rear of its structure, to which corresponding hook and loop fasteners on the cover 905 can attach to keep the cover in place. For example, one or more places on the front, rear, or sides of the legs 150, 155 may have hook and loop fasteners attached (e.g., with an adhesive back) to connect to a corresponding fastener on cover 905. The rear and sides of the back perimeter structure 120 and bottom perimeter structure 135 may likewise have various hook and loop fasteners to connect to corresponding ones on the cover.

Cover 905 is attached to pillows, such as memory foam pillows 910, as shown in FIG. 9. The memory foam pillows may be attached to the pillow in various ways, for example, they can be stitched into the fabric of the cover or attached via hook-and-loop fasteners attached to the inside of the cover so that the user can customize and manipulate the pillows' positioning. Such manipulation and customization of the pillows accommodate different user ailments and backs. For example, someone with scoliosis and sciatica can have different needs for their back. Furthermore, preventative measures can also be leveraged, such as to prevent degenerative disc disease or ailments caused by poor posture.

Figure 10:
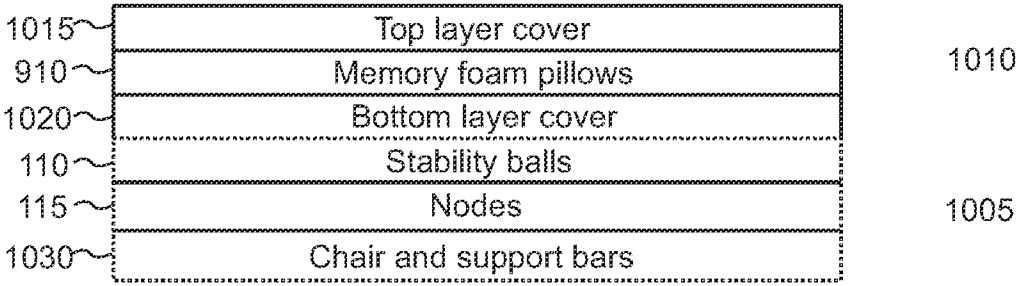
FIG. 10 shows an illustrative layered diagram of the setup when the cover is positioned over the ergonomic chair.

FIG. 10 shows an illustrative layered diagram of the ergonomic massage chair 105 when used with cover 905. The solid lines portion represents components outside the cover, and the broken lines portion represents components inside the cover, as representatively shown by numerals 1010 and 1005. Starting from the bottom, the chair and support bars are represented by numeral 1030. Nodes 115 are attached to the support bars, and chair's structure, and the stability balls 110 are connected to the nodes.

When the cover substantially or at least partially encapsulates the chair, a bottom layer 1020 is adjacent to and may rest against the chair's structure and stability balls. Between the bottom layer cover and the top layer cover 1015 may be memory foam pillows 910 secured in place, such as via stitching. In other implementations, however, the cover may be a single layer with various exposed hook-and-loop fasteners to which the corresponding fasteners on the memory foam pillows can connect.

Various embodiments and implementations are described herein. In one exemplary embodiment, disclosed is an ergonomic massage chair, comprising: a back perimeter structure having at least one support bar extending horizontally from a left side perimeter bar to a right side perimeter bar; a bottom perimeter structure having at least one support bar extending horizontally from a left side perimeter bar to a right side perimeter bar; multiple nodes attached to the ergonomic massage chair, wherein nodes are attached to the back perimeter structure, the bottom perimeter structure, the back perimeter structure's support bar, and the bottom perimeter structure's support bar.

In another example, further comprising threaded holes throughout the ergonomic chair, in which screws extend through the nodes and fasten to the ergonomic massage chair's threaded holes. As another example, wherein the nodes are comprised of rubber. As another example, further comprising multiple horizontally extending support bars on the back perimeter structure. In another example, wherein the horizontally extending support bars for the back and bottom perimeter structures are arched. In a further example, wherein nodes on the back perimeter structure are positioned in between the horizontally extending support bars. In a further example, wherein the nodes are centered on the horizontally extending support bars on the back and bottom perimeter structures. In a further example, further comprising a cover that substantially encapsulates the ergonomic massage chair. As a further example, wherein the cover includes pillows attached thereto. As another example, wherein the pillows are memory foam pillows. In another example, wherein the cover is form-fitting to the ergonomic massage chair.

In another exemplary embodiment is an ergonomic massage chair, comprising: a back perimeter structure having multiple support bars extending horizontally from a left side perimeter bar to a right side perimeter bar; a bottom perimeter structure having at least one support bar extending horizontally from a left side perimeter bar to a right side perimeter bar; and multiple nodes attached to the ergonomic massage chair, wherein nodes are attached to the back perimeter structure, the bottom perimeter structure, the back perimeter structure's support bar, and the bottom perimeter structure's support bar.

In another example, further comprising threaded holes throughout the ergonomic chair, in which screws extend through the nodes and fasten to the ergonomic massage chair's threaded holes. As a further example, wherein the nodes are comprised of rubber. As another example, wherein the nodes each have a hole for receiving a screw that fastens to the ergonomic massage chair. As another example, wherein nodes on the back perimeter structure are positioned in between the horizontally extending support bars. As another example, wherein the nodes are centered on the horizontally extending support bars on the back and bottom perimeter structures. In another example, further comprising a cover that substantially encapsulates the ergonomic massage chair. As another example, wherein the cover includes pillows attached thereto. As another example, wherein the cover is form-fitting to the ergonomic massage chair.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed:

1. An ergonomic massage chair, comprising:

a back perimeter structure having at least one support bar extending horizontally from a left side perimeter bar to a right side perimeter bar;

a bottom perimeter structure having at least one support bar extending horizontally from a left side perimeter bar to a right side perimeter bar;

multiple nodes attached to the ergonomic massage chair, wherein nodes are attached to the back perimeter structure, the bottom perimeter structure, the back perimeter structure's support bar, and the bottom perimeter structure's support bar.

2. The ergonomic massage chair of claim 1, further comprising threaded holes throughout the ergonomic chair, in which screws extend through the nodes and fasten to the ergonomic massage chair's threaded holes.

3. The ergonomic massage chair of claim 1, wherein the nodes are comprised of rubber.

4. The ergonomic massage chair of claim 1, further comprising multiple horizontally extending support bars on the back perimeter structure.

5. The ergonomic massage chair of claim 4, wherein the horizontally extending support bars for the back and bottom perimeter structures are arched.

6. The ergonomic massage chair of claim 5, wherein nodes on the back perimeter structure are positioned in between the horizontally extending support bars.

7. The ergonomic massage chair of claim 6, wherein the nodes are centered on the horizontally extending support bars on the back and bottom perimeter structures.

8. The ergonomic massage chair of claim 7, further comprising a cover that substantially encapsulates the ergonomic massage chair.

9. The ergonomic massage chair of claim 8, wherein the cover includes pillows attached thereto.

10. The ergonomic massage chair of claim 9, wherein the pillows are memory foam pillows.

11. The ergonomic massage chair of claim 8, wherein the cover is form-fitting to the ergonomic massage chair.

12. An ergonomic massage chair, comprising:

a back perimeter structure having multiple support bars extending horizontally from a left side perimeter bar to a right side perimeter bar;

a bottom perimeter structure having at least one support bar extending horizontally from a left side perimeter bar to a right side perimeter bar; and multiple nodes attached to the ergonomic massage chair, wherein nodes are attached to the back perimeter structure, the bottom perimeter structure, the back perimeter structure's support bar, and the bottom perimeter structure's support bar.

13. The ergonomic massage chair of claim 12, further comprising threaded holes throughout the ergonomic chair, in which screws extend through the nodes and fasten to the ergonomic massage chair's threaded holes.

14. The ergonomic massage chair of claim 12, wherein the nodes are comprised of rubber.

15. The ergonomic massage chair of claim 12, wherein the nodes each have a hole for receiving a screw that fastens to the ergonomic massage chair.

16. The ergonomic massage chair of claim 15, wherein nodes on the back perimeter structure are positioned in between the horizontally extending support bars.

17. The ergonomic massage chair of claim 16, wherein the nodes are centered on the horizontally extending support bars on the back and bottom perimeter structures.

18. The ergonomic massage chair of claim 17, further comprising a cover that substantially encapsulates the ergonomic massage chair.

19. The ergonomic massage chair of claim 18, wherein the cover includes pillows attached thereto.

20. The ergonomic massage chair of claim 18, wherein the cover is form-fitting to the ergonomic massage chair.

* * * * *